United States Patent [19]

Mashimo et al.

[11] Patent Number: 4,833,305

[45] Date of Patent: May 23, 1989

[54] THERMALLY SELF-REGULATING ELASTOMERIC COMPOSITION AND HEATING ELEMENT UTILIZING SUCH COMPOSITION

[75] Inventors: Satoshi Mashimo, Akashi; Susumu Nagayasu, Hyogo; Yoshio Yamaguchi, Hyogo; Toru Noguchi, Hyogo; Toshimichi Takada, Nishinomiya; Hajime Kakiuchi, Itami; Takahiro Yonezaki, Hyogo, all of Japan

[73] Assignee: Mitsuboshi Belting Limited, Nagata, Japan

[21] Appl. No.: 84,435

[22] Filed: Aug. 12, 1987

[30] Foreign Application Priority Data

| | | | |
|---|---|---|---|
| Aug. 12, 1986 | [JP] | Japan | 61-189767 |
| Nov. 25, 1986 | [JP] | Japan | 61-281350 |
| Jun. 24, 1987 | [JP] | Japan | 62-97661[U] |

[51] Int. Cl.[4] ..... H05B 3/34

[52] U.S. Cl. ..... 219/549; 219/548; 338/22 R

[58] Field of Search ..... 219/549, 548, 553, 552, 219/547, 548; 338/22 R, 22 SD, 25, 26, 99, 100, 114

[56] References Cited

U.S. PATENT DOCUMENTS

| | | | |
|---|---|---|---|
| 4,400,614 | 8/1983 | Sopory | 219/553 X |
| 4,503,416 | 3/1985 | Kim | 338/99 |
| 4,541,898 | 9/1985 | Mase et al. | 219/553 X |
| 4,582,983 | 4/1986 | Midgley et al. | 219/549 X |
| 4,713,531 | 12/1987 | Fennekels et al. | 219/545 |

*Primary Examiner*—E. A. Goldberg
*Assistant Examiner*—M. M. Lateef
*Attorney, Agent, or Firm*—Wood, Dalton, Phillips, Mason & Rowe

[57] ABSTRACT

A thermally self-regulating elastomeric composition and heating element made therefrom. The composition includes a body of elastomeric material in which is distributed electrically conductive particulate material, such as carbon black. Short fibers are also distributed in the elastomeric matrix. In the disclosed invention, the short fibers are present in the amount of approximately 0.5 to 20 volume percent. In one alternate form, the matrix is foamed. Different arrangements of the electrodes in electrical conductive association with the thermally self-regulating elastomeric body are disclosed. Preferred proportions and characteristics of the particulate conductive material and short fibers providing optimum thermally self-regulating characteristics of the composition are disclosed.

24 Claims, 5 Drawing Sheets

THERMALLY SELF-REGULATING ELASTOMERIC COMPOSITION AND HEATING ELEMENT UTILIZING SUCH COMPOSITION

TECHNICAL FIELD

This invention relates to heating elements and in particular to a thermally self-regulating elastomeric composition suitable for use in such heating elements.

BACKGROUND ART

One form of heating element composition known in the art comprises a mixture of rubber or other elastomeric polymer with conductive particles, such as carbon black and graphite. Such a composition is conventionally known as a thermal composition, and one example thereof is shown in the Japanese Patent Laid Open No. 75705/1983 or No. 8443/1981.

Such thermal compositions are commonly formed of rubber. The composition has a positive temperature coefficient with respect to the heating effect of electrical current passed therethrough. Thus, as the temperature of the composition rises as a result of the current flow through the limitedly conductive material, the positive temperature coefficient thereof causes an increase in the resistance so as to reduce the current. The equilibrium point is reached wherein the current is maintained at a value suitable to produce heat in the body of the composition at a rate equal to the rate at which the heat is dissipated from the surface thereof. Illustrative uses of such heating elements are for melting snow on roofs and the like, preventing of freezing of pipes and road surface areas, etc.

The conventional thermal compositions, however, have a number of serious deficiencies and have not proven completely satisfactory heterofore. Illustratively, because of the relatively small positive temperature coefficient, substantial time is required to arrive at the stable predetermined temperature. The known thermal compositions, further, are relatively unstable and have irregular thermal characteristics, resulting in reduced efficiency and increased poser consumption. Changes in the operating characteristics of the compositions occur because of the thermal expansion and degradation of the composition caused by uneven and excessive heating of different portions thereof.

DISCLOSURE OF INVENTION

The present invention comprehends an improved thermally self-regulating elastomeric composition which eliminates the disadvantages and problems of such known compositions in a novel and simple manner.

More specifically, the present invention comprehends the provision of a thermally self-regulating elastomeric composition including a body of elastomer, electrically conductive particulate matter distributed in the elastomer, and short fibers distributed in the elastomer in an amount in the range of approximately 0.5 to 20 volume percent.

One excellent particulate material for use in such a composition is carbon black.

In one form, the elastomeric material comprises a foamed elastomeric material.

Electrodes are provided at spaced surface portions of the body for conducting electrical current through the body therebetween.

In one form, the electrodes comprise fabric embedded in the spaced surface portions of the body so as to provide improved electrical contact association therewith.

The electrodes may be provided on opposite surfaces of the body.

Alternatively, the electrodes may be provided on laterally spaced portions of a surface of the body.

The short fibers may be oriented generally parallel to the electrode surface portions.

In the illustrated embodiment, the conductive particulate material is preferably present in an amount in the range of approximately 10 to 80 parts by weight to 100 parts by weight of the rubber and, more specifically, in the range of 30 to 60 parts by weight to 100 parts by weight of the rubber.

The conductive material preferably has approximately 20 to 70 mg./g. of specific surface area (iodine absorption amount), and at least approximately 100 DBP oil absorption ml./100 g.

The fibers preferably have an aspect ratio in the range of approximately 100 to 3500.

The fibers preferably have a diameter of at least approximately 0.05 microns and a length of at least approximately 20 microns.

The fibers illustratively comprise organic fibers selected from the group consisting of polyethylene terephthalate, polybutylene terephthalate, polypropylene, polyethylene, and polyether ketone, fatty polyamide, aromatic polyamide, cotton, vinylon, rayon, and acryl.

The fibers are preferably present in an amount in the range of approximately 0.5 to 20 volume percent and, more specifically, in the range of 1 to 15 volume percent.

In one preferred form, the fibers are formed of a terephthalate resin selected from the group consisting of polyethylene terephthalate, polybutylene terephthalate, and polypropylene terephthalate. In forming the foamed elastomeric body, the foaming agent is preferably present in an amount in the range of approximately 2 to 30 parts to 100 parts by weight of the elastomer.

The improved thermally self-regulating elastomeric composition and heating elements made therefrom are extremely simple and economical, while yet providing the highly desirable features discussed above.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
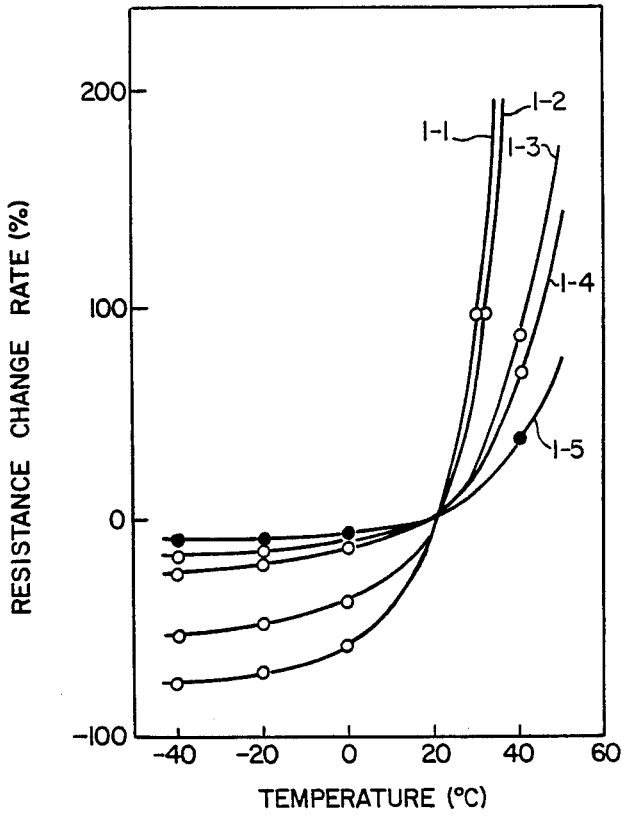
FIG. 1 is a graph illustrating the positive thermal coefficient characteristics of five different compositions embodying the invention.

In the exemplary embodiment of the invention as disclosed in the drawing, a thermally self-regulating elastomeric composition is utilized for forming heating elements arranged to reach a stable equilibrium temperature as a result of an increase in the resistivity of the composition as a function of temperature.

The composition of the present invention comprises a thermally self-regulating elastomeric composition. Suitable elastomeric materials include rubber, such as natural rubber, polybutadiene rubber, polyisoprene rubber, styrene-butadiene copolymer rubber, nitrile rubber, butile rubber, chloroprene rubber, acrylonitrile-butadiene copolymer rubber, ethylene-polypropylene copolymer rubber, silicone rubber, SBS, isoprene, urethane, etc. The composition may include two or more different rubbers. The rubber may be cross-linked by means of sulfur, sulfides, or peroxides, as desired, so as to improve mechanical strength and heat resistance.

The invention further comprehends the use of thermoplastic elastomers which may be used directly or cross-linked, as desired.

Electrically conductive particulate material is distributed in the elastomeric body. Illustratively, the conductive material may comprise carbon black, such as furnace black, acetylene black, thermal black, channel black, and the like. The particulate material preferably has a 20 to 70 mg./g. specific area (iodine absorption) and 100 or more structure (DBP oil absorption ml/100 g).

Where the particulate conductive material is carbon black, it preferably is present in an amount in the range of approximately 10 to 80 parts, and more specifically, present in an amount in the range of 30 to 60 parts by weight to 100 parts by weight of the rubber. By maintaining the proportion as indicated, the composition exhibits desirable thermally self-regulating characteristics.

The short fibers distributed in the elastomer preferably comprise organic fibers, such as polyethylene terephthalate, polybutylene terephthalate, polypropylene terephthalate, polypropylene, polyethylene, polyether ketone, fatty polyamide, aromatic polyamide, cotton, vinyl, and acryl synthetic resins, and inorganic fibers, such as glass, ceramic, carbon, and metal fibers. The fibers may comprise a single type of fiber or a mixture thereof as desired.

The preferable fibers comprise the polyethylene terephthalate and the polybutylene terephthalate fibers indicated above. A composite yarn of polyethylene terephthalates having different molecular weights has also been found to provide excellent characteristics in the composition.

It has been found that the addition of the short fibers imparts improved control of the thermal self-regulation characteristics of the composition.

The short fibers are preferably present in the rubber in an amount in the range of approximately 0.5 to 20 volume percent and, more preferably, in the range of 1 to 15 volume percent.

The fiber length is preferably approximately 20 microns or longer, and the fiber diameter is preferably approximately 0.05 microns or larger. The aspect ratio is preferably in the range of approximately 20 or larger, and preferably in the range of approximately 100 to 3500.

The short fibers may be dispersed in the rubber in an oriented or random distribution, as desired. In one improved form of the composition, the short fibers are oriented parallel to the flat surface of the rubber sheet.

The provision of the short fibers tends to provide localized portions of increased deformation in response to temperature change. Thus, the distributed conductive particulate material is made to be more concentrated or less concentrated in these portions of the rubber as a function of the contraction or expansion of the rubber thereat. This increased change in the spacing of the particles provides an improved accurate thermal self-regulation functioning in the composition not provided in the absence of the short fibers.

Resultingly, it is preferred that the matrix elastomer comprise a material which is different from the material from which the short fibers are formed to provide the desired increased deformation at the opposite ends of the fibers in the matrix. It has been found that the use of a rubber elastomer matrix, with the short fibers being formed of the materials discussed above, provides a highly advantageous composition, in accordance with the invention.

The invention further comprehends the provision of a foamed matrix, within the broad scope of the invention. Thus, where the matrix is formed of rubber, nitroso compound foaming agents, such as N,N'-dinitrosopenthamethylenetetramine, and N,N'-dimethyle-N,N'-dinitrosoterephthalamide, azodicarbonamide, and azo compounds, such as azodicarbonamide and azodisulfonamide, and organic foaming agents, such as sulfonyl hydrazine and benzine-sulfonyl-hydrazide, P,P'-oxibis(-benzenesulfonyl-hydrazide), toluene-sulfonylhydrazide, or inorganic foaming agents, such as sodium bicarbonate, ammonium bicarbonate, and ammonium carbonate, may be utilized. Preferably, the foaming agent is provided in an amount in the range of approximately 2 to 30 parts by weight to 100 parts by weight of rubber.

A foaming assistant material, such as urea and its compounds, may be added to regulate the dispersing temperature of the foaming agent.

The mixing of the composition materials may be effected by any suitable method and, illustratively, may be effected by kneading and pressurizing, such as for example by means of a Banbury mixer, a kneader, or mixing rolls.

The composition may be further provided with one or more of conventional softening agents, antioxidants, activators, vulcanization accelerators, and/or cross-linking agents.

Figure 9:
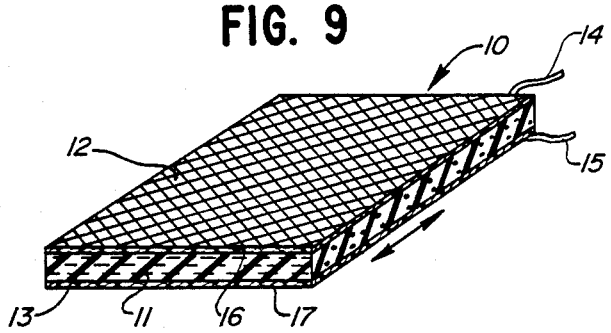
FIG. 9 is a perspective view of a heating element embodying the invention.

In forming a thermally self-regulating electrically energizable heating element, such as heating element generally designated 10 illustrated in FIG. 9, the body of thermally self-regulating elastomeric material generally designated 11 is provided spaced electrodes 12 and 13. The electrodes have electrical conductors 14 and 15, respectively, electrically conductively associated therewith for directing electrical current through the elastomeric body between the electrodes 12 and 13.

In the heating element 10, the electrode 12 is disposed in electrically conductive association with one facial surface portion 16 of the sheetlike body 11, and the opposite electrode is disposed in electrically conductive facial engagement with the opposite facial surface portion 17 of the body 11. Thus, electrically current is passed substantially uniformly between the two electrodes through the intermediate thermally self-regulating elastomeric body 11 to define an improved thermally self-regulating electrically energizable heating element 10.

Figure 10:
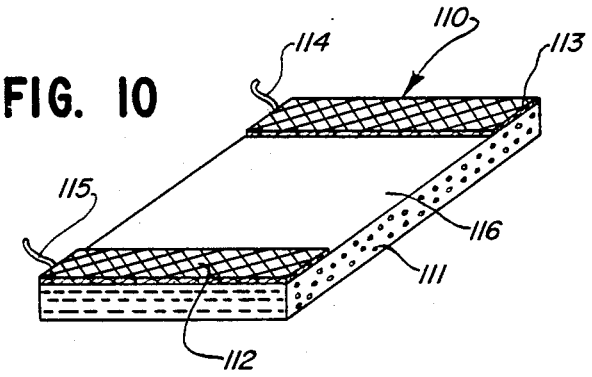
FIG. 10 is a perspective view of another form of heating element embodying the invention.

As illustrated in FIG. 10, a modified form of heating element generally designated 110 is shown to comprise a heating element similar to heating element 10 but having laterally spaced electrodes 112 and 113 electrically conductively facially engaging one facial surface 116 of the thermally self-regulating elastomeric body 111. Thus, current flow in heating element 110 is generally parallel to the surface 116 rather than transversely between the opposite facial surfaces, such as surfaces 16 and 17 of heating element 10.

Figure 11:
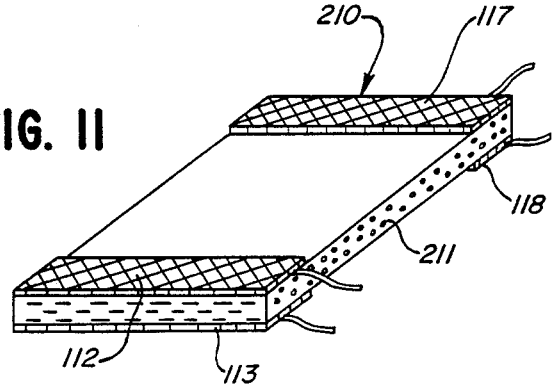
FIG. 11 is a perspective view of still another form of heating element embodying the invention.

Still another form of heating element embodying the invention is illustrated in FIG. 11 wherein a heating element generally designated 210 as shown to comprise a heating element generally similar to heating element 10 and 110, but wherein two pairs of spaced electrodes are provided. Thus, as shown in FIG. 11, one pair of electrodes comprises an electrode 112 facially spaced from a second electrode 113, and the second pair of electrodes comprises an electrode 117 facially spaced from a fourth electrode 118. Further, as shown in FIG. 11, the pair of electrodes 112,113 is spaced laterally from the pair of electrodes 117,118 to provide further improved current flow through the thermally self-regulating elastomeric body 211 in defining the heating element 210.

The electrodes, in the illustrated embodiment, comprise fabrics formed of organic fiber yarns, such as yarns formed of polyester, polyamide, aromatic polyamide, synthetic resin, etc., and may be woven in any desirable form, such as in satin, twill, or plain woven form. The yarns are metallized by deposition or chemical plating with suitable conductive metals, such as nickel, copper, zinc, etc. Further, alternatively, metal fabric may be utilized as the electrode fabric.

Preferably, the surface resistance of the fabric should be no more than approximately 20 ohms/cm$^2$. The fabric preferably has a thickness of approximately 3 mm or less.

The fabric may be laminated to the elastomeric body surface under pressure at an elevated termperature in the range of approximately 130° to 180° C. for improved bonding of the fabric to the elastomeric body in effectively embedded relationship therewith. Thus, the rubber surface portion of the elastomeric body is caused to extend into the interstices of the fabric to provide improved electrical conductivity therebetween. A number of elastomeric bodies embodying the invention were prepared and the thermally self-regulating characteristics thereof compared with elastomeric bodies of the prior art construction. The results of the comparisons are shown in FIGS. 1–8 of the drawing. In forming the test examples, the compositions were formed by kneading in a Banbury mixer. The compositions were then rolled into sheets having a thickness of approximately 2 mm. The sheets were vulcanized in a suitable mold under vulcanizing conditions at approximately 150° C. for approximately 20 minutes.

After vulcanization, the sheet was heat-treated at 70° C. for approximately 300 hours.

The heat-treated sheets were then set into test specimens of approximately 20×20 mm size and allowed to stand for 4 to 6 additional minutes in the oven.

The temperature/electrical resistance characteristics of the test samples were then determined by means of a digital multimeter, and the resulting characteristics found, as indicated in the following Table 1.

TABLE 1

(Unit: parts by weight)

| | Example | | | | | | | C. Example |
|---|---|---|---|---|---|---|---|---|
| | 1-1 | 1-2 | 1-3 | 1-4 | 1-5 | 1-6 | 1-7 | C-1 |
| Chloroprene rubber | 100 | 100 | 100 | 100 | 100 | 100 | 100 | 100 |
| Stearic acid | 2 | 2 | 2 | 2 | 2 | 2 | 2 | 2 |
| Magnesium oxide | 4 | 4 | 4 | 4 | 4 | 4 | 4 | 4 |
| ZnO | 5 | 5 | 5 | 5 | 5 | 5 | 5 | 5 |
| Naphthene process oil | 4 | 4 | 4 | 4 | 4 | 4 | 4 | 4 |
| Ethylene thiourea | 0.5 | 0.5 | 0.5 | 0.5 | 0.5 | 0.5 | 0.5 | 0.5 |
| Antioxidant | 2 | 2 | 2 | 2 | 2 | 2 | 2 | 2 |
| Carbon black *1 | 30 | 32 | 34 | 36 | 38 | 45 | 54 | 30 |
| Short fiber *2 (vol. %) | 10 | 10 | 10 | 10 | 10 | 10 | 10 | |
| Resistance value | 1.8x | 1.7x | 7.8x | 6.0x | 3.4x | 2.6x | 8x | 2.7x |
| Change Rate (%) | $10^5$ | $10^5$ | $10^4$ | $10^4$ | $10^4$ | $10^3$ | $10^2$ | $10^3$ |

*1: Furnace Black - DBP oil absorption: 133 ml/100 g
Iodine absorption: 53 mg/g
*2: PET - Aspect ratio: 286
Change rate (%) = R(t) − R (20° C.))/R (20° C.) × 100 (where t = 100° C.).

The carbon black used in the tests discussed above was furnace black, having a DBP oil absorption characteristic of 133 ml/100 g and iodine absorption of 53 mg/g. The aspect ratio of the short fibers was 286.

FIG. 1 of the drawing is a graph showing the relationship between the resistance change rate and temperature for the difference examples, wherein the carbon black amount was varied, as indicated in Table 1. As shown in FIG. 1, excellent results were obtained where the particulate conductive material, i.e. the carbon black, was present in the range of approximately 30 to 38 parts by weight.

Figure 2:
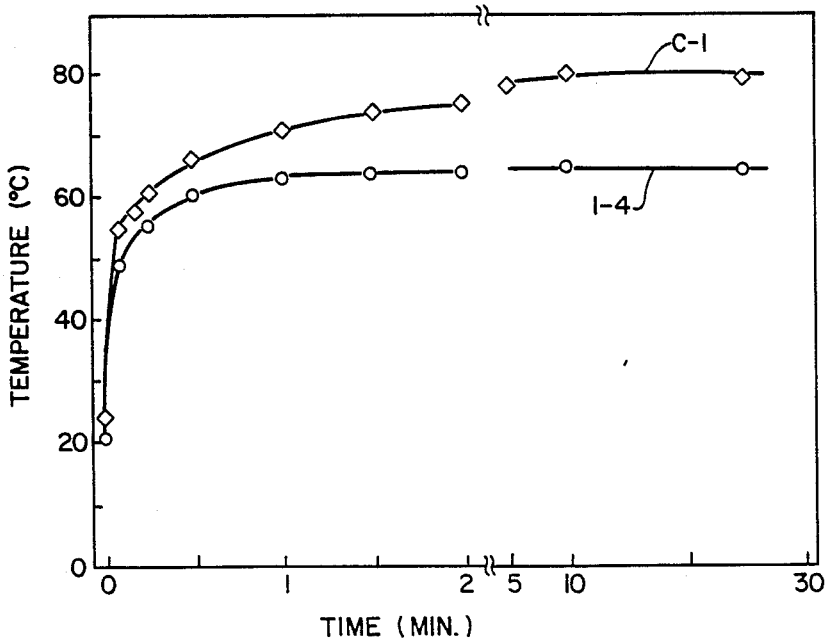
FIG. 2 is a graph illustrating the temperature/time characteristics of one of the compositions of FIG. 1 compared to such characteristics of a comparison composition.

Improved characteristics of the composition of the invention is illustrated in FIG. 2. Test electrodes were provided on the opposite faces of the test pieces in the form of silver paste, and a voltage of 100 volts AC was applied in the electrodes to heat the test pieces. As shown in FIG. 2, the illustrative test sample 1–4 achieved the desirable constant temperature in a relatively short time, whereas the comparison sample continued to increase in temperature long after the samples made in accordance with the invention reached the stable temperature.

Figure 3:
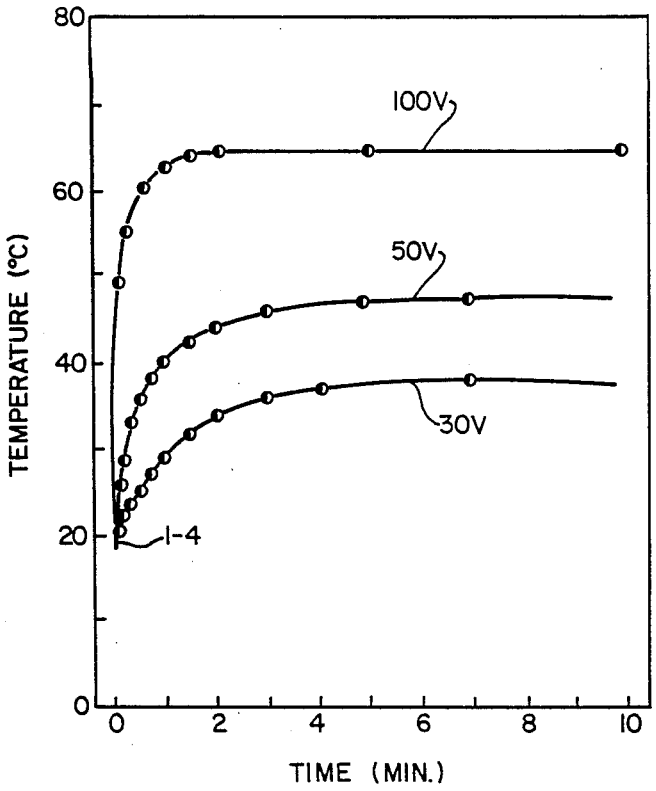
FIG. 3 is a graph illustrating the temperature/time characteristics of the example of FIG. 2, illustrating the effect of different applied voltages producing different effective currents through the composition.

Referring to FIG. 3, the same rapidly stabilizing characteristics of the composition 1–4 made in accordance with the invention is seen to be obtained with different voltages applied thereacross. Thus, while the temperature of the composition at the stable temperature increases with the applied voltage in each case of the three indicated different voltages of 30, 50 and 100, the stable temperature was quickly reached.

Figure 4:
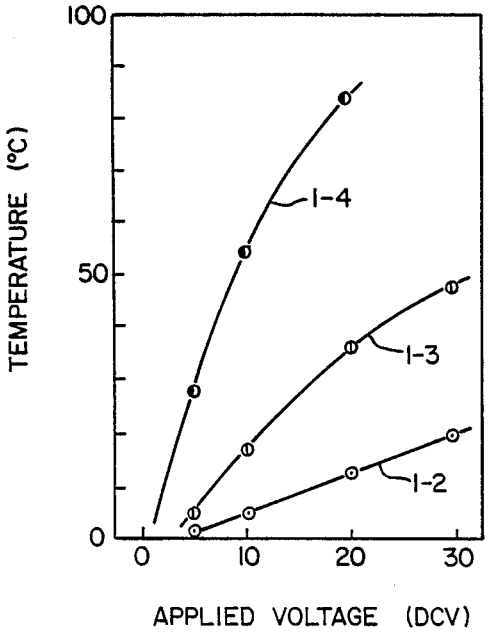
FIG. 4 is a graph showing the rise in temperature of the different compositions relative to the applied voltage.

Still further, the improved characteristics of the composition made in accordance with the invention, as shown in FIG. 4, exhibited desirable temperature characteristics where the applied voltage was a direct current voltage. As further shown in FIG. 4, the heating effect is exhibited at very low values of the direct current voltage.

Additional test pieces 2-1, 2-2, 2-3, and 2-4 were made utilizing NB rubber, nitrile rubber, EPOT, silicone rubber, and styrene-isoprene-styrene block copolymer in lieu of the chloroprene rubber of the first examples. The specific formulations are indicated in Table 2 herefollowing. The resistance value change rates are indicated in Table 2 for each of the compositions using the different matrix materials. The short fiber had the same aspect ratio of the examples of Table 1 and was provided in the same volume percent amount in each of the Table 2 formulations.

TABLE 2

(Unit: parts by weight)

| | Example 2 | | | |
|---|---|---|---|---|
| | 2-1 | 2-2 | 2-3 | 2-4 |
| NBR | 100 | | | |
| NR | | 100 | | |
| EPT | | | 100 | |
| Silicone | | | | 100 |
| SIS | | | | |
| Stearic acid | 0.5 | 1 | 1 | |
| ZnO | 5 | | 5 | |
| Process oil | | | 15 | |
| Antioxidant | | 4 | 4.5 | |
| Sulfur | 2 | 2 | | |
| Vulcanizer *3 | | | | 2 |
| Vulcanizer *4 | | | 2 | |
| Accelerator *5 | 3 | | | |
| Accelerator *6 | | 1 | | |
| Coagent *7 | | | 1 | |
| Plasticizer | 20 | | | |
| Carbon black | 36 | 36 | 36 | 36 |
| Short fiber (Vol. %) | 10 | 10 | 10 | 10 |
| Resistance value Change Rate (%) | 5.0x $10^3$ | 2.9x $10^3$ | 1.9x $10^4$ | 1.7x $10^3$ |

*3: Dicumyl peroxide
*4: 1,3-bis(t-butylperoxy-iso-propyl)benzene
*5: N—cyclohexyl-2-benzothiazylsulfeneamide
*6: N—oxydimethyl-2-benzothiazolsulfeneamide
*7: Ethyleneglycol-dimethacrylate A third set of test specimens was formed, as indicated in Table 3 below, wherein different short fibers were utilized as shown.

TABLE 3

(Unit: parts by weight)

| | Example 3 | | | C. Example |
|---|---|---|---|---|
| | 3-1 | 3-2 | 3-3 | 2 |
| Chloroprene rubber | 100 | 100 | 100 | 100 |
| Stearic acid | 2 | 2 | 2 | 2 |
| Magnesium oxide | 4 | 4 | 4 | 4 |
| ZnO | 5 | 5 | 5 | 5 |
| Napthene process oil | 4 | 4 | 4 | 4 |
| Ethylene thiourea | 0.5 | 0.5 | 0.5 | 0.5 |
| Antioxidant | 2 | 2 | 2 | 2 |
| Carbon black *1 | 36 | 36 | 36 | 36 |
| PET *2 | 10 | | | |

TABLE 3-continued (Unit: parts by weight)

| | Example 3 | | | C. Example |
|---|---|---|---|---|
| | 3-1 | 3-2 | 3-3 | 2 |
| Polyester composite yarn *8 | | 10 | | |
| Nylon-6 *9 | | | 10 | |

*2: Aspect ratio 286
*8: Aspect ratio 2500
*9: Aspect ratio 222

Figure 5:
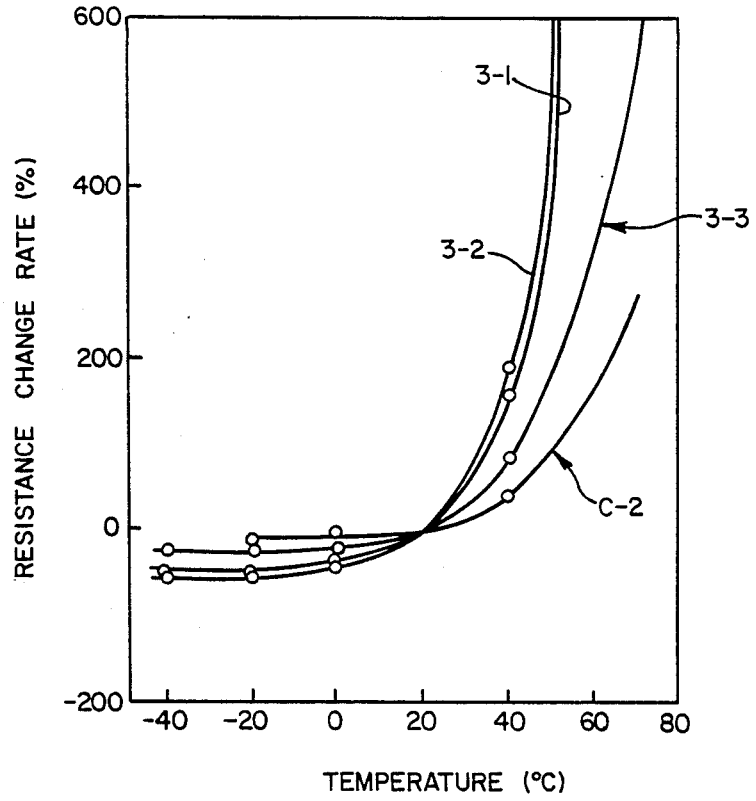
FIG. 5 is a graph illustrating the resistance variation rate relative to the temperature for a number of different exemplary compositions embodying the invention.

Thus, Example 3-1 utilized polyethylene terephthalate fibers having an aspect ratio of 286, Example 3-2 utilized polyethylene terephthalate composite yarn having an aspect ratio of 2005, and Example 3-3 utilized nylon 6 yarn having an aspect ration of 222. The temperature coefficient characteristics of the different compositions is illustrated in FIG. 5. Again, the compositions utilizing the short fibers of the inventions exhibit substantially improved characteristics relative to the comparison specimen C-2, as illustrated in FIG. 5.

Additional specimens of the formulation of Table 3 were made, wherein the polyethylene terephthalate yarn was utilized having a 21-micron thickness, with shorter lengths of 6, 2, and 0.5 mm. The resistance change rates for these three further examples were $6\times10^4 6\times10^3$, and $3\times10^3$, respectively.

Further test samples were made utilizing different types of carbon black, as indicated in Table 4 below.

TABLE 4

(Type of carbon black)

| | Examples | | | | |
|---|---|---|---|---|---|
| | 5-1 | 5-2 | 5-3 | 5-4 | 5-5 |
| Structure (DBP oil absorption ml/100 g) | 100 | 130 | 145 | 110–130 | 110–130 |
| Specific surface area (Iodine absorption mg/g) | 45 | 45 | 45 | 70 | 120 |
| Resistance Change Rate $\times 10^4$ (5) | 2.7 | 6.0 | 16 | 3.8 | 0.06 |

The formulations were similar to those illustrated in Table 3, except for this variation in the carbon black characteristics.

A foamable thermal rubber composition was made in accordance with the invention wherein the rubber mixture contained 2 parts of stearic acid, 4 parts of magnesium oxide, 5 parts of zinc oxide, 4 parts of napthene process oil, 0.5 parts of ethylene thiourea, 2 parts of antioxidant, 30 parts carbon black, and, alternatively, 10, 20, or 30 parts of foaming agent (Cellmike S made by Sankyo Kasei Co., of Japan), by weight, and 10% volume percent of short fibers (polyethylene terephthalate fibers having an aspect ratio of 286), in 100 parts by weight of chloroprene rubber. The material was kneaded in a Banbury mixer and extruded by rolls into a sheet having 2 mm thickness. Woven fabric electrodes plated with nickel on polyester woven yarn were laminated on the upper and lower surfaces of the sheet, and the sheet was interposed in a mold and then vulcanized under 150° C. for 20 minutes, during which time the foaming action also took place. The shape was stabilized by secondary vulcanization under dry thermal ambient conditions and suitable pressure at a temperature of 160° C. for 10 minutes. The foaming magnification of the thermal composition material was approximately 1.5 times the original volume. After vulcanization, the sheet was heat treated in an oven at 70° C. for 300 hours.

The heat-treated sheet was then cut to 40×10 mm test specimens, and the electrical resistance thereof was measured by digital multimeter.

Figure 6:
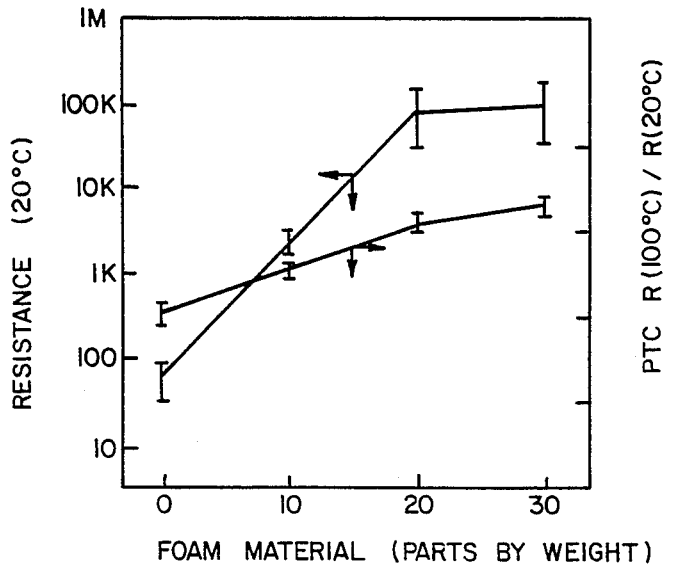
FIG. 6 is a graph showing the relationship between the resistance and the amount of foam agent utilized in the elastomeric body.
Figure 7:
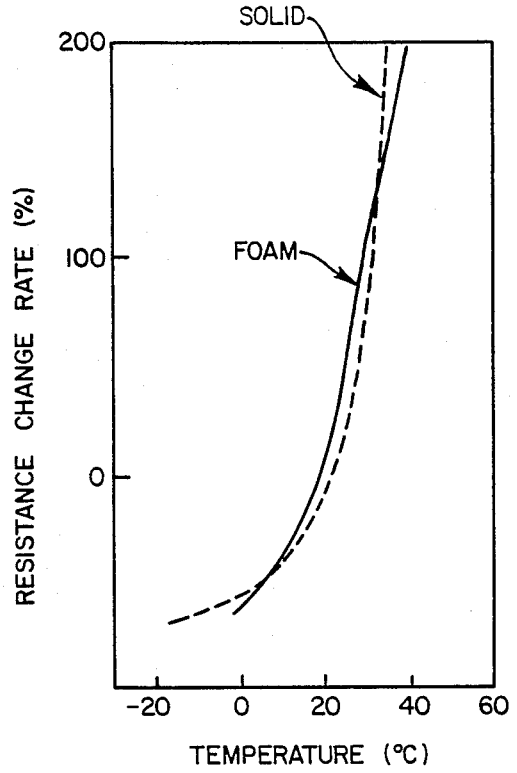
FIG. 7 is a graph illustrating the relationship between the resistance variation rate and the temperature of a solid-type rubber composition embodying the invention and a foamed-type rubber composition embodying the invention.

The relationship between the filling amount of the foaming agent, the resistance of the material at 20° C. and the ratio of the resistance at 100° C. to the resistance at 20° C. is illustrated in FIG. 6. As shown in that figure, as the parts by weight of the foam material to 100 parts of the rubber increases, the resistance value at 20° C. and the positive temperature coefficient characteristics are improved. The resistance change rate is compared to the temperature in FIG. 7 with respect to the foamed sample and the nonfoamed composition. Thus, as seen in FIG. 7, the foamed rubber material exhibits a similar improved positive temperature coefficient characteristic as compared to that of the nonfoamed composition.

Test pieces of the foamed composition were formed into heating elements by the provision on the surfaces thereof of suitable electrode materials formed of fiber cloth. The test samples utilized 20 parts by weight of the foaming agent and the fiber cloth was laminated into the surface portions. The composition was vulcanized at 150° C. for 20 minutes and then secondarily vulcanized under dry ambient pressure conditions at 160° C. for 10 minutes. The composition was then heat treated and cut to 40×40 mm test pieces. Both the foamed test pieces and similar nonfoamed test pieces were mounted in a vacuum chamber filled with heat insulating material. A DC voltage was applied across each of the test pieces so that the power consumption was constant under the constant ambient temperature. The surface temperatures and power consumption rates were measured at the ambient temperature of 20° C. after approximately 5 hours of operation. The surface temperatures and the power consumption of the test pieces was measured after reducing the temperature of 15° C. for a period of 5 to 10 hours, and the results are illustrated in FIG. 8.

Figure 8:
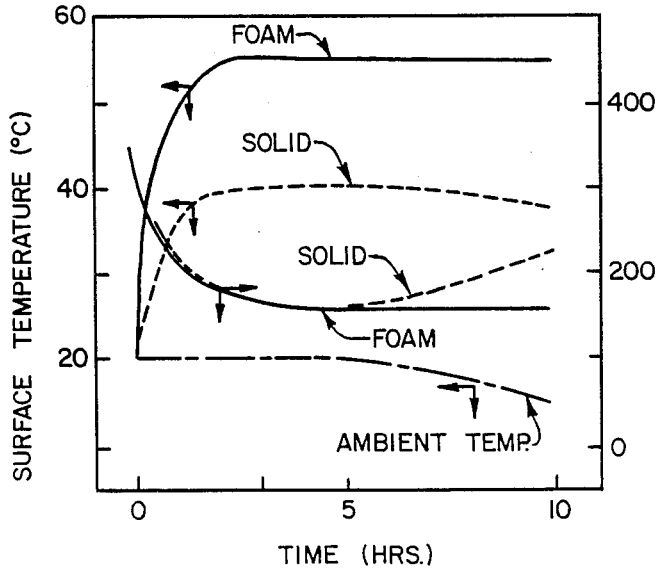
FIG. 8 is a graph illustrating the relationship between the surface temperature and the atmospheric temperature over a period of time.

Thus, as shown in FIG. 8, the foamed thermal rubber material exhibited a higher stable temperature as compared to the nonfoamed material under the same power consumption. Thus, when used as a stable heating element, the foamed composition achieved the desired stable temperature with less total applied energy.

The foamed composition maintained its surface temperature notwithstanding a drop in the ambient temperature for a period of up to approximately 5 hours, whereas, the nonfoamed composition decreased somewhat in temperature during that time. Resultingly, it is necessary to increase the power consumption in order to maintain the desired temperature where the ambient temperature decreases.

The different test results indicated above clearly show the superiority of the thermal rubber composition of the present invention utilizing the distributed conductive particulate material, such as carbon black, in conjunction with the short fibers in the elastomeric matrix. The test results indicate improved thermally self-regulating elastomeric characteristics. The foamed rubber shows improved characteristics in holding the surface temperature notwithstanding a drop in the ambient temperature, with reduced power consumption and, thus, increased efficiency in the use of the heating elements utilizing the composition of the present invention.

As the electrodes may comprise flexible fabric, facilitated manufacture of the heating elements from the improved thermally self-regulating elastomeric composition of the present invention where a wide variety of different applications may be readily effected. Thus, the heating element may be readily shaped and cut to fit curved and other irregular surfaces so as to provide improved efficiency in heat transfer therebetween, while yet providing the highly desirable thermally self-regulating characteristics of the elements.

The foregoing disclosure of specific embodiments is illustrative of the broad inventive concepts comprehended by the invention.

We claim:

1. A thermally self-regulating elastomeric composition comprising:

a body of elastomer;

electrically conductive particulate matter distributed in said elastomer; and short fibers distributed in said elastomer in an amount in the range of approximately 0.5 to 20 volume percent.

2. A thermally self-regulating electrically energizable heating element comprising:

a body of elastomer defining spaced surface portions;

electrically conductive particulate matter distributed in said elastomer;

short fibers distributed in said elastomer in an amount in the range of approximately 0.5 to 20 volume percent; and electrodes in electrically conductive association with said body at said surfaces for conducting electrical current through said body therebetween.

3. The elastomeric composite of claim 1 or heating element of claim 2 wherein said elastomer comprises rubber.

4. The elastomeric composite of claim 1 or heating element of claim 2 wherein said conductive particulate matter comprises carbon black.

5. The elastomeric composite of claim 1 or heating element of claim 2 wherein said conductive particulate matter comprises carbon black present in an amount in the range of approximately 10 to 80 parts by weight to 100 parts by weight of the rubber.

6. The elastomeric composite of claim 1 or heating element of claim 2 wherein said conductive particulate matter comprises carbon black present in an amount in the range of approximately 30 to 60 parts by weight of the rubber.

7. The elastomeric composite of claim 1 or heating element of claim 2 wherein said conductive particulate matter comprises carbon black having approximately 20 to 70 mg. of specific surface area iodine absorption amount.

8. The elastomeric composite of claim 1 or heating element of claim 2 wherein said conductive particulate matter comprises carbon black having at least approximately 100 DBP oil absorption ml./100 g.

9. The elastomeric composite of claim 1 or heating element of claim 2 wherein said fibers have an aspect ratio in the range of approximately 100 to 3500.

10. The elastomeric composite of claim 1 or heating element of claim 2 wherein said fibers have a diameter of at least approximately 0.05 microns.

11. The elastomeric composite of claim 1 or heating element of claim 2 wherein said fibers have a length of at least approximately 20 microns.

12. The elastomeric composite of claim 1 or heating element of claim 2 wherein said fibers are organic fibers selected from the groups consisting of polyethylene terephthalate, polybutylene terephthalate, polypropylene, polyethylene, and polyether ketone, fatty polyamide, aromatic polyamide, cotton, vinylon, rayon, and acryl.

13. The elastomeric composite of claim 1 or heating element of claim 2 wherein said elastomeric body comprises a foamed elastomeric body.

14. The elastomeric composite of claim 1 or heating element of claim 2 wherein said fibers are present in an amount in the range of approximately 1 to 15 volume percent.

15. The elastomeric composite of claim 1 or heating element of claim 2 wherein said fibers are oriented in generally parallel relationship in said body.

16. The elastomeric composite of claim 1 or heating element of claim 2 wherein said fibers are formed of terephthalate resin selected from the group consisting of polyethylene terephthalate, polybutylene terephthalate, and polypropylene terephalate.

17. The heating element of claim 2 wherein said electrodes comprises conductive fabric.

18. The heating element of claim 2 wherein said surface portions comprise spaced parallel apposite surface portions of the body.

19. The heating element of claim 2 wherein said surface portions comprise laterally spaced surface portions of the body.

20. The heating element of claim 2 wherein said spaced surface portions comprise coplanar flat surface portions of the body.

21. The heating element of claim 2 wherein said electrodes comprise conductive fabric embedded in said spaced surface portions of the body.

22. A thermally self-regulating electrically energizable heating element comprising:

a body of foamed elastomer defining spaced surface portions;

electrically conductive particulate matter distributed in said elastomer;

short fibers distributed in said elastomer in an amount in the range of approximately 0.5 to 20 volume percent; and electrodes in electrically conductive association with said body at said surfaces for conducting electrical current through said body therebetween.

23. The heating element of claim 22 wherein the elastomer comprises an elastomer foamed by inclusion therein of foaming agent present in an amount in the range of approximately 2 to 30 parts by weight to 100 parts by weight of the elastomer.

24. The heating element of claim 22 wherein said foamed elastomer comprises foamed rubber.

* * * * *